US010741973B2

(12) United States Patent
Yufu et al.

(10) Patent No.: US 10,741,973 B2
(45) Date of Patent: Aug. 11, 2020

(54) ELECTRICAL CABLE CONNECTOR

(71) Applicant: DAI-ICHI SEIKO CO., LTD., Kyoto (JP)

(72) Inventors: Kenji Yufu, Tokyo (JP); Takao Yamauchi, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 16/402,923

(22) Filed: May 3, 2019

(65) Prior Publication Data

US 2019/0348800 A1 Nov. 14, 2019

(30) Foreign Application Priority Data

May 10, 2018 (JP) ..... 2018-091725

(51) Int. Cl.
*H01R 13/6582* (2011.01)
*H01R 13/6593* (2011.01)
(Continued)

(52) U.S. Cl.
CPC ..... *H01R 13/6582* (2013.01); *H01R 12/75* (2013.01); *H01R 13/05* (2013.01); *H01R 13/6593* (2013.01)

(58) Field of Classification Search
CPC . H01R 13/6582; H01R 12/75; H01R 13/6593
(Continued)

(56) References Cited

U.S. PATENT DOCUMENTS 6,830,478 B1 * 12/2004 Ko ..... H01R 13/6275 439/579
8,043,114 B2 * 10/2011 Kaneko ..... H01R 12/714 439/497
(Continued)

FOREIGN PATENT DOCUMENTS

JP 2004-259672 A 9/2004
JP 2010-157368 A 7/2010
(Continued)

OTHER PUBLICATIONS

An Office Action mailed by the Japanese Patent Office dated Feb. 12, 2020, which corresponds to Japanese Patent Application No. 2018-091725 and is related to U.S. Appl. No. 16/402,923.

*Primary Examiner* — Abdullah A Riyami
*Assistant Examiner* — Marcus E Harcum
(74) *Attorney, Agent, or Firm* — Studebaker & Brackett PC

(57) ABSTRACT

An electrical cable connector comprising an insulating housing, a plurality of conductive contacts arranged on the insulating housing to be connected respectively with cables, and an outer shell member attached to the insulating housing, wherein the insulating housing is provided with a cable supporting portion reinforced with an inner shell member for supporting the cables connected respectively with the conductive contacts and the outer shell member includes a concealing portion for covering a portion of the insulating housing on which the conductive contacts are arranged, a strip-shaped portion for surrounding partially the insulating housing for coming into resilient contact with a mate electrical connector and a linking portion extending from the concealing portion to be linked with the inner shell member.

7 Claims, 9 Drawing Sheets

(51) Int. Cl.
*H01R 13/05* (2006.01)
*H01R 12/75* (2011.01)

(58) Field of Classification Search
USPC ..... 439/581, 607.41, 660
See application file for complete search history.

(56) References Cited

U.S. PATENT DOCUMENTS 8,241,065 B2 * 8/2012 Ikari ..... H01R 12/775
439/372
8,465,324 B2 * 6/2013 Ikari ..... H01R 12/79
439/495
8,512,058 B2 * 8/2013 Ozeki ..... H01R 12/772
439/260
8,602,812 B2 * 12/2013 Ohsaka ..... H01R 12/775
439/497
9,112,302 B2 * 8/2015 Liao ..... H01R 12/598
9,281,597 B2 * 3/2016 Hashiguchi ..... H01R 13/24
9,397,447 B2 * 7/2016 Kurachi ..... H01R 12/79
2009/0068890 A1 * 3/2009 Horiuchi ..... H01R 4/20
439/607.41
2011/0177721 A1 * 7/2011 Yotsutani ..... H01R 12/79
439/660
2011/0207356 A1 * 8/2011 Yamaji ..... H01R 12/82
439/345
2012/0276788 A1 * 11/2012 Takano ..... H01R 13/631
439/784
2014/0345127 A1 * 11/2014 Ohsaka ..... H01R 9/038
29/857
2016/0156116 A1 * 6/2016 Kurachi ..... H01R 12/7005
439/78
2016/0218471 A1 * 7/2016 Hashimoto ..... H01R 24/44
2016/0308308 A1 * 10/2016 Masunaga ..... H01R 12/7005
2019/0348784 A1 * 11/2019 Yufu ..... H01R 13/6581
2019/0372270 A1 * 12/2019 Masunaga ..... H01R 12/83

FOREIGN PATENT DOCUMENTS

JP 2012-089435 A 5/2012
JP 2015-230840 A 12/2015

* cited by examiner

ELECTRICAL CABLE CONNECTOR

BACKGROUND OF THE INVENTION

Field of the Invention

The present invention relates generally to an electrical cable connector, and more particularly to an improvement in an electrical cable connector, to which a plurality of cables, such as relatively thin coaxial cables, are connected, and which is used to be coupled with a mate electrical connector mounted on a circuit board for putting the cables connected thereto in electrical linkage with the circuit board.

Description of the Prior Art Including Information Disclosed Under 37 CFR 1.97 and 37 CFR 1.98

When a plurality of cables, such as relatively thin coaxial cables, are put in electrical linkage with a circuit board on which various electrical parts are mounted, there have been often utilized an electrical cable connector constituting a plug connector, to which the cables are connected, and a mate electrical connector constituting a receptacle connector mounted on and connected electrically with the circuit board, with which the electrical cable connector is coupled. On that occasion, the electrical cable connector is provided with a plurality of conductive contacts arranged on an insulating housing to be electrically connected respectively with the cables and the mate electrical connector is provided with a plurality of mate conductive contacts arranged on a mate insulating housing to be electrically connected respectively with signal terminals provided on the circuit board.

Under a condition wherein the electrical cable connector is coupled with the mate electrical connector, the insulating housing of the electrical cable connector is fitted to the mate insulating housing of the mate electrical connector and thereby the conductive contacts of the electrical cable connector are contact-connected respectively with the mate conductive contacts of the mate electrical connector. As a result, the cables connected to the plug connector are electrically linked, through the conductive contacts of the electrical cable connector and the mate conductive contacts of the mate electrical connector, with the circuit board on which the mate electrical connector is mounted.

Along with miniaturization on each of the electrical cable connector constituting the plug connector and the mate electrical connector constituting the receptacle connector, it is usual that the electrical cable connector coupled with the mate electrical connector is required for achieving low profile to be subjected to effective reduction in its thickness in a direction perpendicular to the parts-mounting surface of the circuit board on which the mate electrical connector is mounted.

Therefore, there have been previously proposed several electrical cable connectors each constituting the plug connector, each of which is provided with a contraption for achieving low profile, as disclosed in, for example, the Japanese patent application published before examination under publication number 2004-259672 (hereinafter, referred to as a published prior art document).

An electrical cable connector (a coaxial connector (10)) disclosed in the published prior art document mentioned above comprises an insulating housing (a housing (5)) made of insulator such as plastics or the like and a plurality of conductive contacts (terminals (3)) arranged on the insulating housing. Each of the conductive contacts has a cable connecting portion (a connecting piece (31)) to which a core conductor (an inner conductor (11)) of a coaxial cable (1) is connected, a contact-connecting portion (a contacting piece (32)) for contacting with a mate conductive contact (a signal terminal (42)) of a mate electrical connector (a mate connector (4)) to be connected with the same, and first and second linking portions (first and second linking pieces (33, 34)) for causing the cable connecting portion and the contact-connecting portion to be lined with each other. The insulating housing is provided with a cable supporting portion (a plate-like portion positioned under the coaxial cable (1) in FIG. 1 of the published prior art document) for supporting the coaxial cables (1), each of which has the core conductor connected with the cable connecting portion of the conductive contact.

In each of the conductive contacts, the cable connecting portion is put on a part of the cable supporting portion of the insulating housing so that the cable connecting portion and the second linking portion extend in a direction along the cable supporting portion, the contact-connecting portion extends from the second linking portion in a direction perpendicular to the direction along the cable supporting portion, and the first linking portion extends from the cable connecting portion to the second linking portion in the direction perpendicular to the direction along the cable supporting portion to be opposite to the contact-connecting portion so that a step is formed between the cable supporting portion and the second linking portion in the direction perpendicular to the direction along the cable supporting portion.

When the electrical cable connector is coupled with the mate electrical connector, the step formed on each of the conductive contacts of the electrical cable connector as mentioned above is operative to cause the cable connecting portion of each of the conductive contacts to come close to a parts-mounting surface of a circuit board on which the mate electrical connector is mounted. This results in that the step formed on each of the conductive contacts of the electrical cable connector contributes to low profile of the electrical cable connector.

In the previously proposed electrical cable connector (the coaxial connector (10)) which has the insulating housing provided with the cable supporting portion as disclosed in the published prior art document mentioned above, there are the following defects or disadvantages.

The cable supporting portion provided on the insulating housing of the electrical cable connector disclosed in the published prior art document constitutes a part of the insulating housing to be shaped into the plate-like portion and is operative to support the coaxial cables (1) each having the core conductor connected to the cable connecting portion of the conductive contact at a position near the circuit board on which the mate electrical connector is mounted when the electrical cable connector is coupled with the mate electrical connector. Under such a condition, the cable supporting portion shaped into the plate-like portion is compelled to have relatively thin thickness so as not to deteriorate the low profile of the electrical cable connector brought about by the step formed on each of the conductive contacts of the electrical cable connector as described above. Therefore, the cable supporting portion of the insulating housing which is made of insulator such as plastics or the like and shaped into the plate-like portion having relatively thin thickness is insufficient in its strength and easily deformed or damaged by external force applied to the insulating housing. As a result, it is feared that the coaxial cables cannot be properly and stably supported by the cable supporting portion of the insulating housing.

BRIEF SUMMARY OF THE INVENTION

Accordingly, it is an object of the present invention to provide an electrical cable connector having an insulating housing on which a plurality of conductive contacts are arranged to be connected respectively with cables, such as relatively thin coaxial cables, and a cable supporting portion is provided as a part of the insulating housing for supporting the cables, and operative to be coupled with a mate electrical connector mounted on a circuit board for putting the cables connected with the conductive contacts in electrical linkage with the circuit board, and which avoids the aforementioned problems and disadvantages encountered with the prior art.

Another object of the present invention is to provide an electrical cable connector having an insulating housing on which a plurality of conductive contacts are arranged to be connected respectively with cables, such as relatively thin coaxial cables, and a cable supporting portion is provided as a part of the insulating housing for supporting the cables, and being operative to be coupled with a mate electrical connector mounted on a circuit board for putting the cables connected with the conductive contacts in electrical linkage with the circuit board, and in which the cable supporting portion of the insulating housing is able to possess necessary and sufficient strength for supporting properly and stably the cables even under a situation wherein the electrical cable connector as a whole is subjected to reduction in its thickness for achieving low profile.

A further object of the present invention is to provide an electrical cable connector having an insulating housing on which a plurality of conductive contacts are arranged to be connected respectively with cables, such as relatively thin coaxial cables, and a cable supporting portion is provided as a part of the insulating housing for supporting the cables, and being operative to be coupled with a mate electrical connector mounted on a circuit board for putting the cables connected with the conductive contacts in electrical linkage with the circuit board, and which is able to be maintained properly and surely in coupling with the mate electrical connector even under a situation wherein the electrical cable connector as a whole is subjected to reduction in its thickness for achieving low profile.

According to the present invention, there is provided an electrical cable connector comprising an insulating housing provided to be fitted to a mate insulating housing of a mate electrical connector fixed to a parts-mounting surface of a circuit board, a plurality of conductive contacts arranged on the insulating housing to be connected respectively with cables and put in contact respectively with mate conductive contacts provided in the mate electrical connector, and an outer shell member attached to the insulating housing for covering partially the insulating housing, wherein the insulating housing is provided with a cable supporting portion which is reinforced with an inner shell member made of metal plate material to be provided on the cable supporting portion for supporting the cables connected respectively with the conductive contacts, and the outer shell member includes a concealing portion for concealing a portion of the insulating housing on which the conductive contacts are arranged, a strip-shaped portion linked with the concealing portion to surround partially the insulating housing for coming into resilient contact with the mate electrical connector and a linking portion extending from the concealing portion to be linked with the inner shell member provided on the cable supporting portion. The outer shell member further includes, for example, an extended strip-shaped portion extending to be bent from one of end portions of the strip-shaped portion so as to have a free end portion and the linking portion is, for example, placed for positioning the extended strip-shaped portion.

In the electrical cable connector thus constituted in accordance with the present invention, the insulating housing on which the conductive contacts are arranged is provided with the cable supporting portion for supporting the cables connected respectively with the conductive contacts and the cable supporting portion is accompanied with the inner shell member made of metal plate material to be provided thereon. The inner shell member provided on the cable supporting portion is operative to reinforce the cable supporting portion without preventing the electrical cable connector from being subjected to low profile. Thereby, the cables connected respectively with the conductive contacts are supported with the cable supporting portion reinforced with the inner shell member even under a situation wherein the electrical cable connector is reduced in its thickness for achieving low profile.

Further, the outer shell member attached to the insulating housing for covering partially the insulating housing is provided with the concealing portion for covering the portion of the insulating housing on which the conductive contacts are arranged and the strip-shaped portion linked with the concealing portion to surround partially the insulating housing for coming into resilient contact with the mate electrical connector. When the electrical cable connector accompanied with the cables connected respectively with the conductive contacts arranged on the insulating housing is coupled with the mate electrical connector fixed to the parts-mounting surface of the circuit board, the insulating housing is fitted to the mate insulating housing of the mate electrical connector and each of the conductive contacts connected respectively with the cables is put in contact with a corresponding one of the mate conductive contacts arranged on the mate insulating housing of the mate electrical connector. Thereby, the cables connected respectively with the conductive contacts of the electrical cable connector are electrically linked, through the electrical cable connector and the mate electrical connector, with the circuit board on which the mate electrical connector is mounted.

Under a condition wherein the electrical cable connector according to the present invention is coupled with the mate electrical connector in such a manner as described above, the strip-shaped portion of the outer shell member which is linked with the concealing portion of the outer shell member to surround partially the insulating housing, is operative to come into resilient contact with the mate electrical connector and the linking portion extending from the concealing portion of the outer shell portion, which is, for example, placed for positioning the extended strip-shaped portion which extends to be bent from one of end portions of the strip-shaped portion so as to have the free end portion, is linked with the inner shell member provided on the cable supporting portion of the insulating housing. This results in that the strip-shaped portion of the outer shell member having the end portions, from each of which the extended strip-shaped portion further extend, for example, is operative to cause the electrical cable connector to be locked to the mate electrical connector and thereby the electrical cable connector according to the present invention is properly and stably maintained in coupling with the mate electrical connector.

In the electrical cable connector according to the present invention, the insulating housing on which the conductive contacts are arranged is provided with the cable supporting portion for supporting the cables connected respectively with the conductive contacts and the cable supporting portion of the insulating housing is accompanied with the inner shell member made of metal plate material to be provided on the cable supporting portion. The inner shell member provided on the cable supporting portion is operative to reinforce the cable supporting portion without preventing the electrical cable connector from being subjected to low profile. Therefore, with the electrical cable connector according to the present invention, the cable supporting portion of the insulating housing is able to possess necessary and sufficient strength for supporting properly and stably the cables even under the situation wherein the electrical cable connector as a whole is subjected to reduction in its thickness for achieving low profile.

In addition, the electrical cable connector according to the present invention has the outer shell member which is provided with the concealing portion for covering the portion of the insulating housing on which the conductive contacts are arranged and the strip-shaped portion linked with the concealing portion to surround partially the insulating housing for coming into resilient contact with the mate electrical connector, and under the condition wherein the electrical cable connector according to the present invention is coupled with the mate electrical connector, the strip-shaped portion of the outer shell member is operative to come into resilient contact with the mate electrical connector and the linking portion extending from the concealing portion of the outer shell portion, which is, for example, placed for positioning the extended strip-shaped portion which extends to be bent from one of end portions of the strip-shaped portion so as to have the free end portion, is linked with the inner shell member provided on the cable supporting portion of the insulating housing, so that the strip-shaped portion of the outer shell member having the end portions, from each of which the extended strip-shaped portion further extend, for example, is operative to cause the electrical cable connector to be locked to the mate electrical connector. As a result, the electrical cable connector according to the present invention is able to be maintained properly and surely in coupling with the mate electrical connector even under the situation wherein the electrical cable connector as a whole is subjected to reduction in its thickness for achieving low profile.

The above, and other objects, features and advantages of the present invention will become apparent from the following detailed description taken in conjunction with the accompanying drawings.

DETAILED DESCRIPTION OF THE INVENTION

Figure 1:
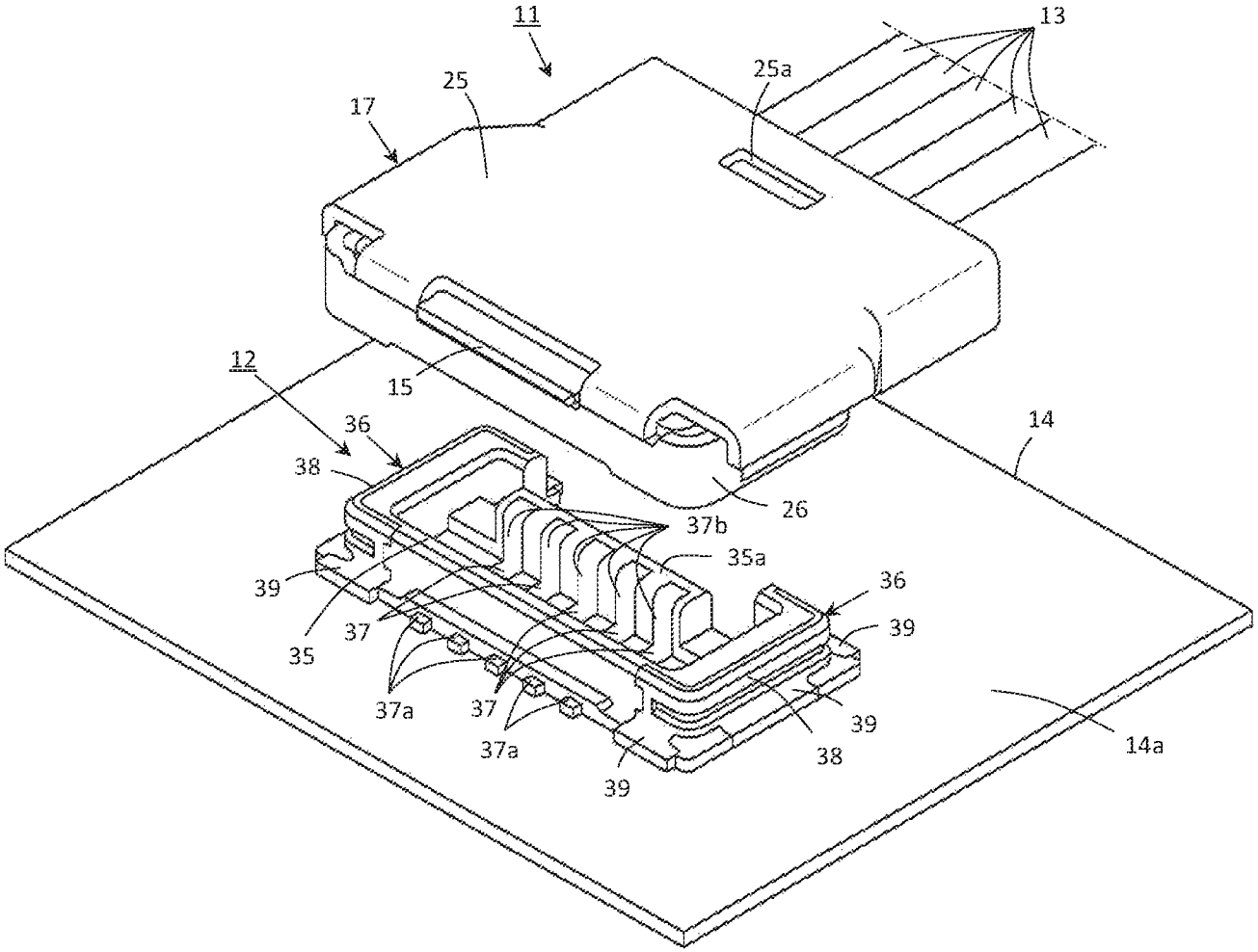
FIG. 1 is a schematic perspective view showing an embodiment of electrical cable connector according to the present invention which constitutes a plug connector, together with a plurality of coaxial cables connected with the plug connector, and a mating electrical connector which constitutes a receptacle connector and with which the plug connector is to be coupled, together with a circuit board on which the receptacle connector is mounted.

FIG. 1 shows a plug connector 11 which is constituted with an embodiment of electrical cable connector according to the present invention and accompanied with a plurality of relatively thin coaxial cables 13 connected thereto, and a receptacle connector 12 which is constituted with a mating electrical connector mounted on a circuit board 14 and with which the plug connector 11 is to be coupled. The receptacle connector 12 is fixed to a parts-mounting surface 14*a* of the circuit board 14, which faces upward in FIG. 1.

Figure 2:
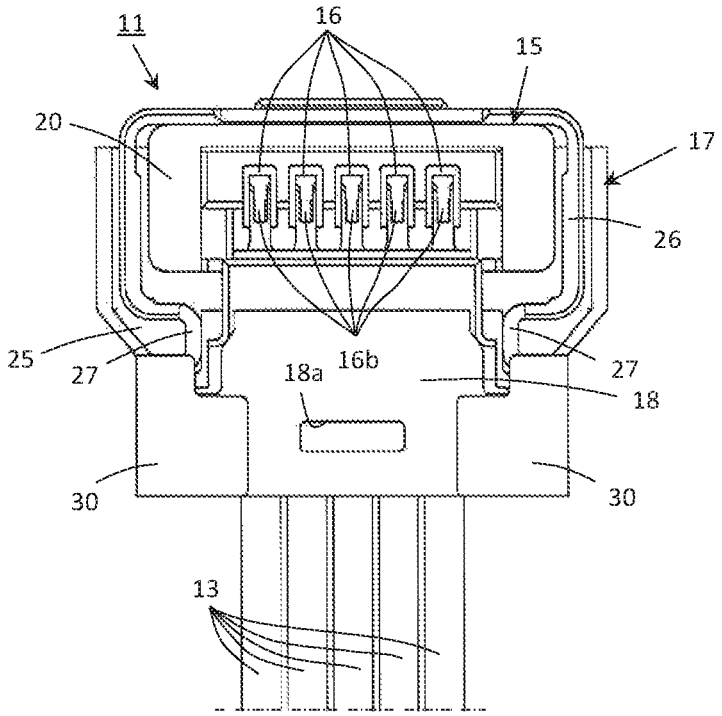
FIG. 2 is a schematic bottom view showing the plug connector accompanied with the coaxial cables as shown in FIG. 1.

The plug connector 11, that is, the embodiment of electrical cable connector according to the present invention, comprises an insulating housing 15 made of insulator such as plastics or the like, a plurality of conductive contacts 16 arranged on the insulating housing 15 and an outer shell member 17 attached to the insulating housing 15, as shown also in FIG. 2. The insulating housing 15 is provided with an inner shell member 18 which is made of metal plate material and integrated with the insulating housing 15 by means of insert molding so as to reinforce the insulating housing 15 without preventing the plug connector 11 from being subjected to low profile. Each of the conductive contacts 16 is made of resilient conductive plate material to be shaped into a strip. The outer shell member 17 is made of resilient conductive plate material subjected to bending processing.

Figure 3:
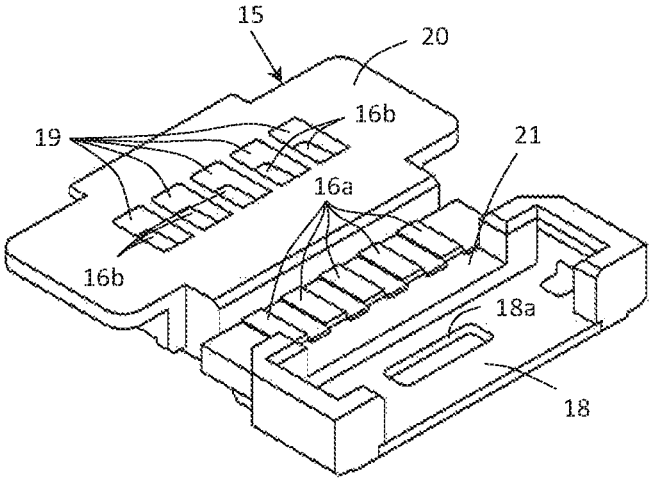
FIG. 3 is a schematic perspective view showing an insulating housing employed in the plug connector shown in FIG. 1, together with an inner shell member and a plurality of conductive contacts arranged on the insulating housing.

As shown in FIG. 3, the insulating housing 15 accompanied with the inner shell member 18 has a top board portion 20 on which a plurality of through-holes 19 are arranged and a cable supporting portion 21 which is reinforced with the inner shell member 18. The cable supporting portion constituting a part of the insulating housing 15 is subjected to reinforcement with the inner shell member 18 made of metal plate material and integrated with the insulating housing 15 by means of insert molding in such a manner that the plug connector 11 is not prevented from being subjected to low profile.

Each of the conductive contacts 16 arranged on the insulating housing 15 is provided with a cable connecting portion 16*a* to be connected with a core conductor 13*a* (shown in FIG. 4 explained later) of the coaxial cable 13 and a contact-connecting portion 16*b* operative to be put in contact with a mate conductive contact 37 (shown in FIG. 10 explained later) provided on the receptacle connector 12 fixed to the parts-mounting surface 14*a* of the circuit board 14, and integrated with the insulating housing 15 to be partially buried therein by means of insert molding. The cable connecting portion 16*a* of each of the conductive contacts 16 is exposed outward on the cable supporting portion 21 of the insulating housing 15 and the contact-connecting portion 16*b* of each of the conductive contacts 16 is put in the through-hole 19 on the top board portion 20 of the insulating housing 15.

Figure 4:
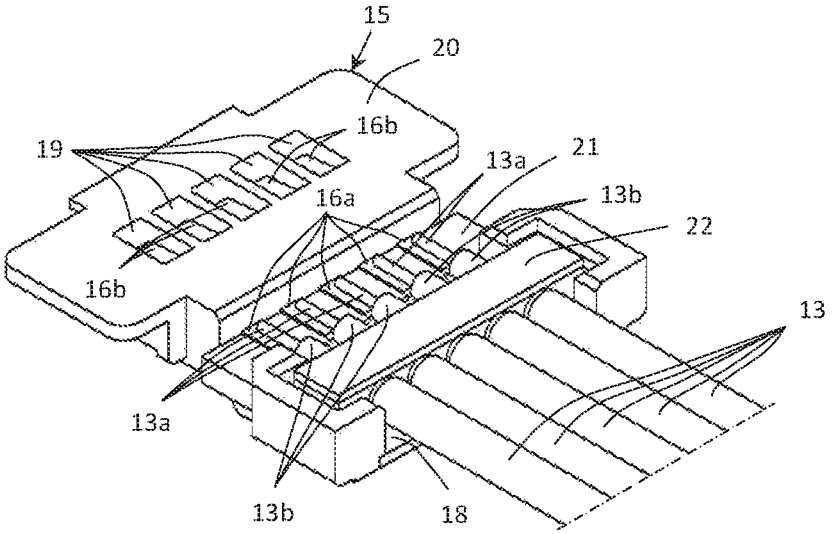
FIG. 4 is a schematic perspective view showing a condition wherein the coaxial cables shown in FIG. 1 are connected respectively with the conductive contacts shown in FIG. 3 and outer conductors which the coaxial cables have respectively are linked with a ground bar member.
Figure 5:
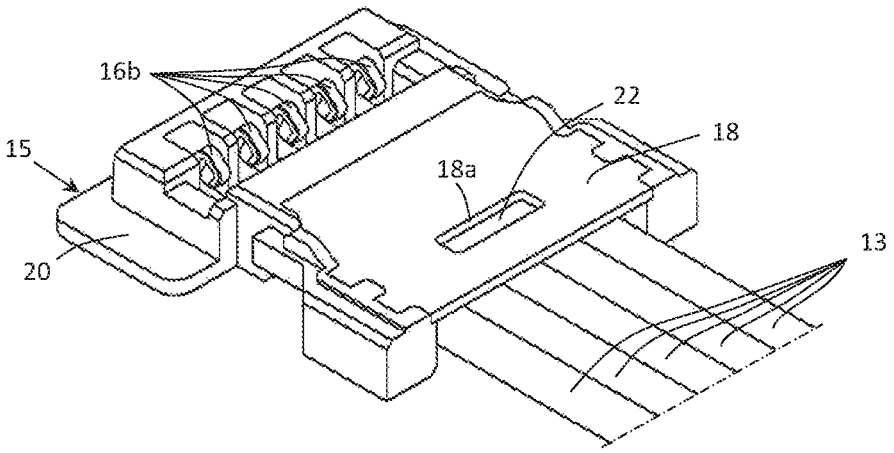
FIG. 5 is a schematic bottom view showing the condition wherein the coaxial cables shown in FIG. 1 are connected respectively with the conductive contacts shown in FIG. 3.

As shown in FIGS. 4 and 5, the coaxial cables 13, each of which has an end portion at which the core conductor 13*a* and an outer conductor 13*b* are exposed, are put on the insulating housing 15 accompanied with the inner shell member 18 as shown in FIG. 3 in such a manner that the core conductor 13*a* of each of the coaxial cables 13 is positioned on the cable connecting portion 16*a* of a corresponding one of the conductive contacts 16 exposed outward at the cable supporting portion 21 of the insulating housing 15 and the outer conductor 13*b* of each of the coaxial cables 13 is positioned on the inner shell member 18 reinforcing the cable supporting portion 21 of the insulating housing 15. Then, the core conductor 13*a* of each of the coaxial cables 13 is connected with the cable connecting portion 16*a* of the corresponding one of the conductive contacts 16 by means of, for example, soldering and the outer conductor 13*b* of each of the coaxial cable 13 is put between a pair of ground bar members 22 facing each other so that the outer conductors 13*b* provided respectively in the coaxial cables 13 are linked with the ground bar members 22. A portion of the inner shell member 18 is soldered to the one of the ground bar members 22 facing each other through a through-holes 18*a* formed on the inner shell member 18. It is not absolutely necessary for the portion of the inner shell member 18 to be soldered to the ground bar member 22, and for example, it is also possible that the portion of the inner shell member 18 is subjected to pressure connection with the ground bar member 22.

As a result, such a condition wherein the cable supporting portion 21 of the insulating housing 15 reinforced with the inner shell member 18 is operative to support, without any insulator put thereon, the coaxial cables 13 each having the core conductor 13*a* connected with the cable connecting portion 16*a* of the conductive contact 16 and the outer conductor 13*b* linked with the ground bar members 22, is obtained. On that occasion, since the inner shell member 18 is operative to reinforce the cable supporting portion 21 of the insulating housing 15 without preventing the plug connector 11 from being subjected to low profile, the cable supporting portion 21 is able to possess necessary and sufficient strength for supporting properly and stably the cables in the manner wherein the plug connector 11 is not prevented from being subjected to low profile.

Figure 6:
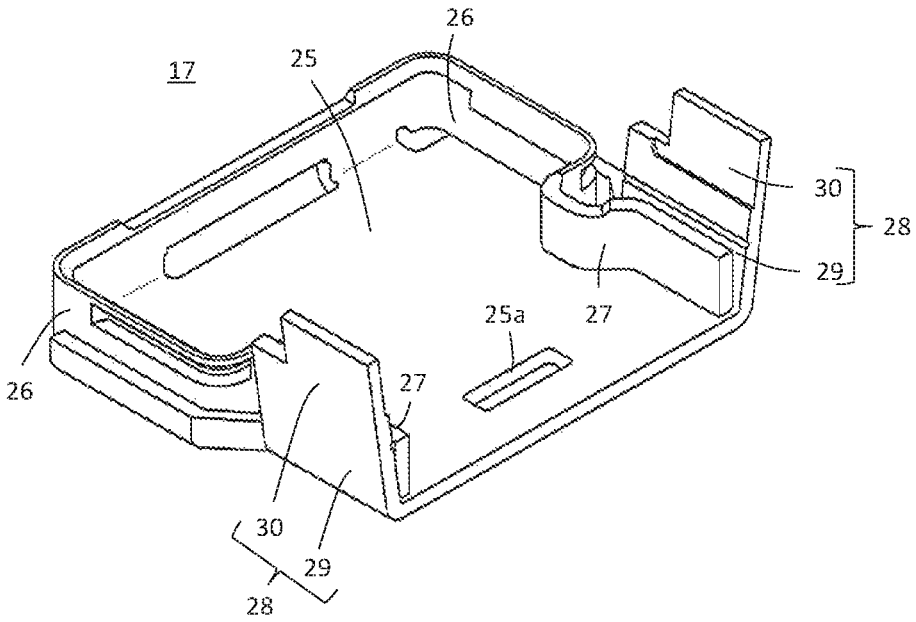
FIG. 6 is a schematic perspective view showing a resilient she member employed in the plug connector shown in FIG. 1.

As shown also in FIG. 6, the outer shell member 17 attached to the insulating housing 15 of the plug connector 11 shown in FIG. 1 includes a concealing portion 25 for concealing the top board portion 20 of the insulating housing 15 on which the conductive contacts 16 are arranged and the cable supporting portion 21 of the insulating housing 15 reinforced with the inner shell member 18, a strip-shaped portion 26 linked with the concealing portion 25 to surround partially the insulating housing 15, and a pair of extended strip-shaped portions 27 each extending to be bent from one of end portions of the strip-shaped portion 26 so as to have a free end portion. The strip-shaped portion 26 of the outer shell member 17 having the end portions thereof from which the extended strip-shaped portions 27 extend respectively, constitutes a spring member. A pair of linking portions 28, each of which extends from the concealing portion 25, are provided for positioning respectively the extended strip-shaped portions 27 from the outside thereof. Each of the linking portions 28 extending from the concealing portion 25 has a constraining portion 29 extending along an outer surface of the extended strip-shaped portion 27 from the concealing portion 25 and a covering portion 30 elongating to be bendable from the constraining portion 29 for covering the extended strip-shaped portions 27. Under such a condition, the strip-shaped portion 26 of the outer shell member 17 is operative to cause an inner surface portion thereof to come into resilient contact with an outer surface portion of the receptacle connector 12 when the plug connector 11 is coupled with the receptacle connector 12.

The outer shell member 17 constitutes a single member with the strip-shaped portion 26 surrounding partially the insulating housing 15. The end portions of the strip-shaped portion 26 face each other with a predetermined space therebetween and the extended strip-shaped portions 27 extend to be bent respectively from the end portions of the strip-shaped portion 26 so as to be opposite to each other. The linking portions 28 corresponding respectively to the extended strip-shaped portions 27 extend from the concealing portion 25 so as to be opposite to each other. However, it is not necessary for the outer shell member 17 to be limited to such an example as shown in FIGS. 1 and 6. For example, it is also possible that the outer shell member 17 constitutes first and second shell components attached to the insulating housing 15 and each of the first and second shell components is provided with a part of the strip-shaped portion 26 and the extended strip-shaped portion 27. In such a case, the part of the strip-shaped portion 26 of the first shell component and the part of the strip-shaped portion 26 of the second shell component face each other with the insulating housing 15 therebetween, the extended strip-shaped portion 27 of the first shell component and the extended strip-shaped portion 27 of the second shell component are opposite to each other with a predetermined space therebetween so as to cause the free end portions provided respectively on the extended strip-shaped portions 27 to be opposite to each other, and each of the extended strip-shaped portions 27 is positioned from the outside thereof with the linking portion 28 extending from the concealing portion 25.

Figure 7:
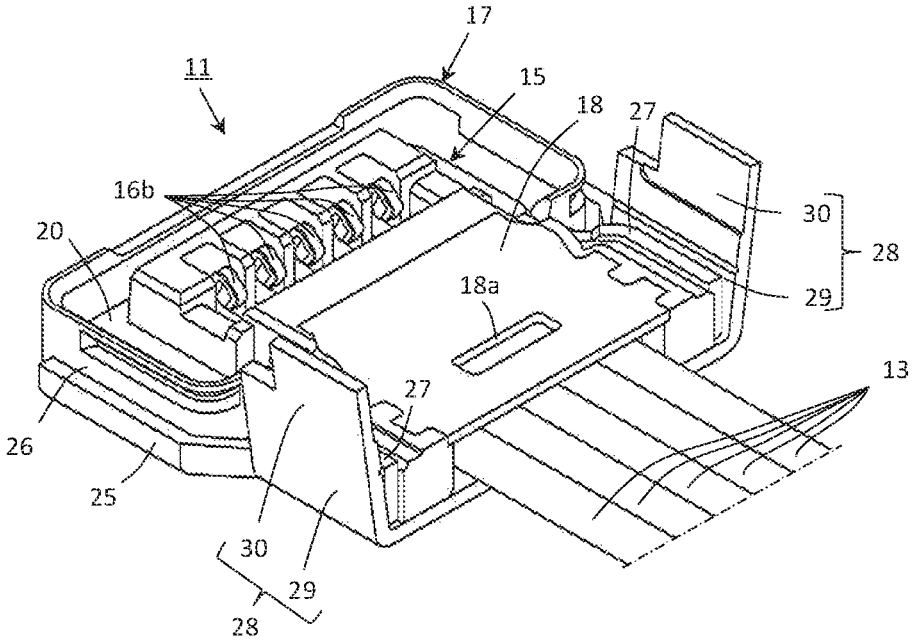
FIG. 7 is a schematic perspective view showing a condition wherein the resilient shell member shown in FIG. 6 is attached to the insulating housing on which the inner shell member and the conductive contacts with which the coaxial cables are connected respectively are arranged as shown in FIG. 5.
Figure 8:
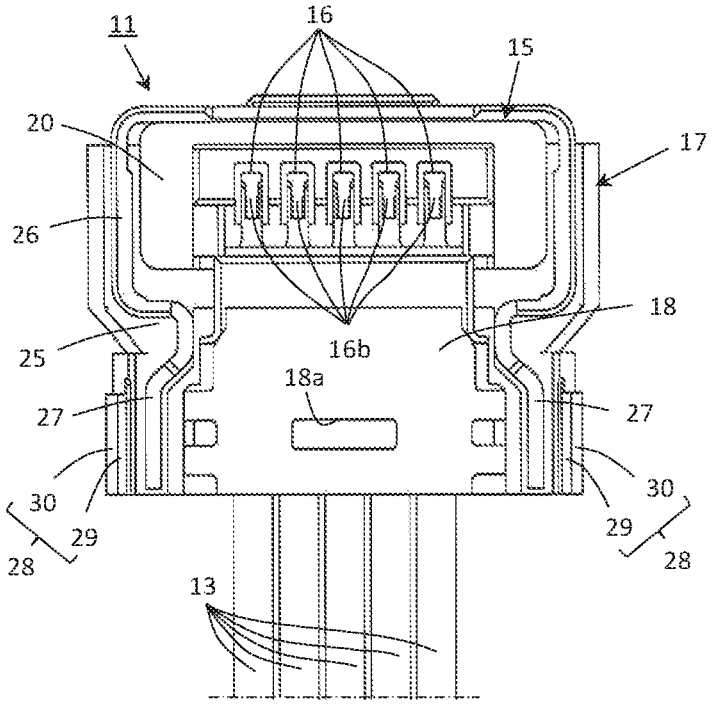
FIG. 8 is a schematic bottom view showing the condition wherein the resilient shell member shown in FIG. 6 is attached to the insulating housing on which the inner shell member and the conductive contacts with which the coaxial cables are connected respectively are arranged as shown in FIG. 5.

As shown in FIGS. 7 and 8, the outer shell member 17 shown in FIG. 6 is caused to be attached to the insulating housing 15 which is provided with the inner shell member 18 shown as shown in FIG. 5 and on which the conductive contacts 16 with which the coaxial cables 13 are connected respectively are arranged. On that occasion, the concealing portion 25 of the outer shell member 17 covers the top board portion 20 of the insulating housing 15 on which the conductive contacts 16 are arranged and the cable supporting portion 21 of the insulating housing 15 reinforced with the inner shell member 18, the strip-shaped portion 26 linked with the concealing portion 25 surrounds partially the top board portion 20 of the insulating housing 15, and the extended strip-shaped portions 27 elongating respectively from the end portions of the strip-shaped portion 26 are opposite to each other with the cable supporting portion 21 of the insulating housing 15 therebetween.

Figure 9:
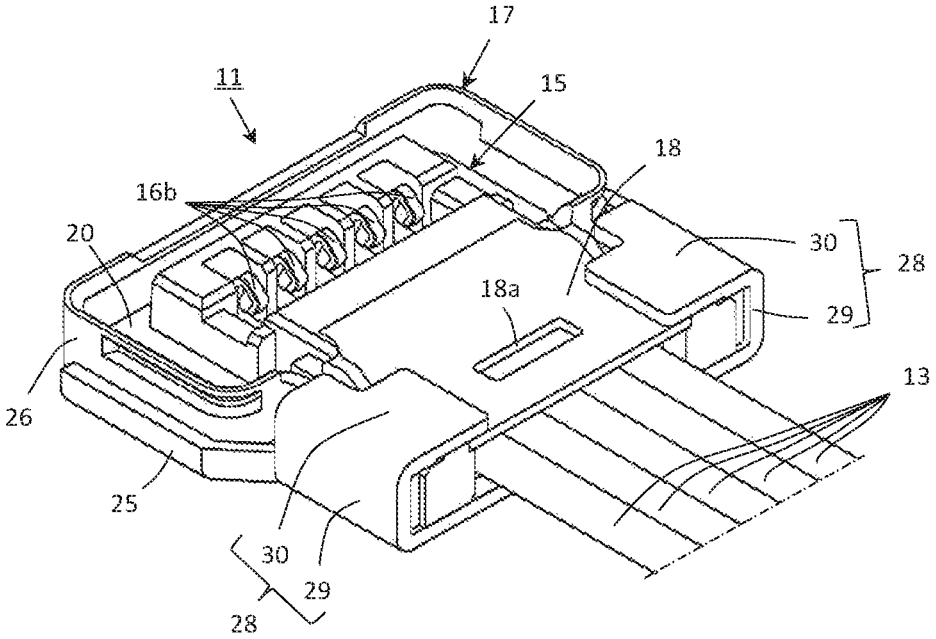
FIG. 9 is a schematic perspective view showing a condition wherein a pair of holding portions of the resilient shell member shown in FIG. 7 are folded down.

After the outer shell member 17 is attached to the insulating housing 15 which is provided with the inner shell member 18 and on which the conductive contacts 16 with which the coaxial cables 13 are connected respectively are arranged, as shown in FIGS. 7 and 8, each of the covering portions 30 constituting respectively the linking portions 28 each extending from the concealing portion 25 of the outer shell member 17 is bent inward, so that each of the extended strip-shaped portions 27 of the outer shell member 17 is positioned from the outside thereof with the constraining portion 29 constituting the linking portion 28 and covered with the covering portion 30 constituting the linking portions 28, as shown in FIG. 9. On that occasion, the covering portions 30 each bent inward are connected with the inner shell member 18 by means of, for example, caulking. Therefore, the linking portions 28 each extending from the concealing portion 25 of the outer shell member 17 are linked with the inner shell member 18 reinforcing the cable supporting portion 21 of the insulating housing 15 and each of the extended strip-shaped portions 27 is properly and surely positioned with the linking portion 28 including the constraining portion 29 and the covering portion 30. Further, the concealing portion 25 of the outer shell member 17 is connected with the other of the ground bar members 22, which are facing each other with the outer conductors 13*b* provided respectively in the coaxial cables 13 therebetween, by means of, for example, soldering through a through-hole 25*a* formed on the concealing portion 25. As a result, the plug connector 11 with which the coaxial cables 13 are connected as shown in FIG. 1 is obtained.

Figure 10:
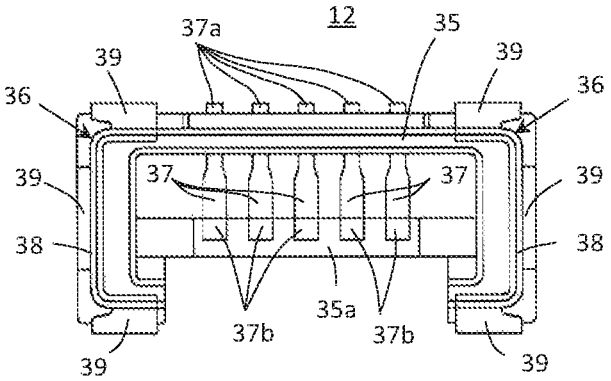
FIG. 10 is a schematic plan view showing the receptacle connector shown in FIG. 1.

The receptacle connector 12, which is constituted with the mate electrical connector and with which the plug connector 11 is to be coupled, is provided with a mate insulating housing 35 made of insulator such as plastics or the like and a pair of holding metal members 36 fixed to the mate insulating housing 35 by means of, for example, insert molding, as shown also in FIG. 10.

The mate insulating housing 35 has a protrusion 35*a* which comes into the plug connector 11 when the plug connector 11 is coupled with the receptacle connector 12. A plurality of mate conductive contacts 37 are arranged on the mate insulating housing 35. Each of the mate conductive contacts 37 is made of resilient conductive plate material to be shaped into a strip and provided, respectively at both end portions of the stripe, with a board connecting portion 37*a* to be connected with a circuit terminal provided on the parts-mounting surface 14*a* of the circuit board 14 and a contact-connecting portion 37*b* operative to be put in contact with the contact-connecting portion 16*b* of the conductive contact 16 provided on the plug connector 11 with which the coaxial cables 13 are connected. The board connecting portions 37*a* provided respectively on the mate conductive contacts 37 are arranged to project from the mate insulating housing 35 to the outside of the mate insulating housing 35 so as to be connected respectively with the circuit terminals provided on the parts-mounting surface 14*a* of the circuit board 14 by means of, for example, soldering. The contact-connecting portions 37*b* provided respectively on the mate conductive contacts 37 are arranged along an inside wall surface and a top surface of the protrusion 35*a* provided on the mate insulating housing 35.

The holding metal members 36 are placed to be opposite to each other with the mate insulating housing 35 therebetween in a direction along which the mate conductive contacts 37 are arranged on the mate insulating housing 35. Each of the holding metal members 36 has a body portion 38 extending along the mate insulating housing 35 and a plurality of fixing portions 39 each projecting from the body portion 38 to be fixed to the parts-mounting surface 14*a* of the circuit board 14. When the plug connector 11 is coupled with the receptacle connector 12, the strip-shaped portion 26 of the outer shell member 17 provided on the plug connector 11 causes the inner surface portion thereof to come into contact with an outer surface portion of the body portion 38. Each of the fixing portions 39 is fixed to the parts-mounting surface 14*a* of the circuit board 14 by means of, for example, soldering and thereby the receptacle connector 12 is fixed to the parts-mounting surface 14*a* of the circuit board 14.

Under such a condition, the plug connector 11 which is constituted with the embodiment of circuit board connecting device according to the present invention is caused to be coupled with the receptacle connector 12 which is constituted with the mating connecting device.

Figure 11:
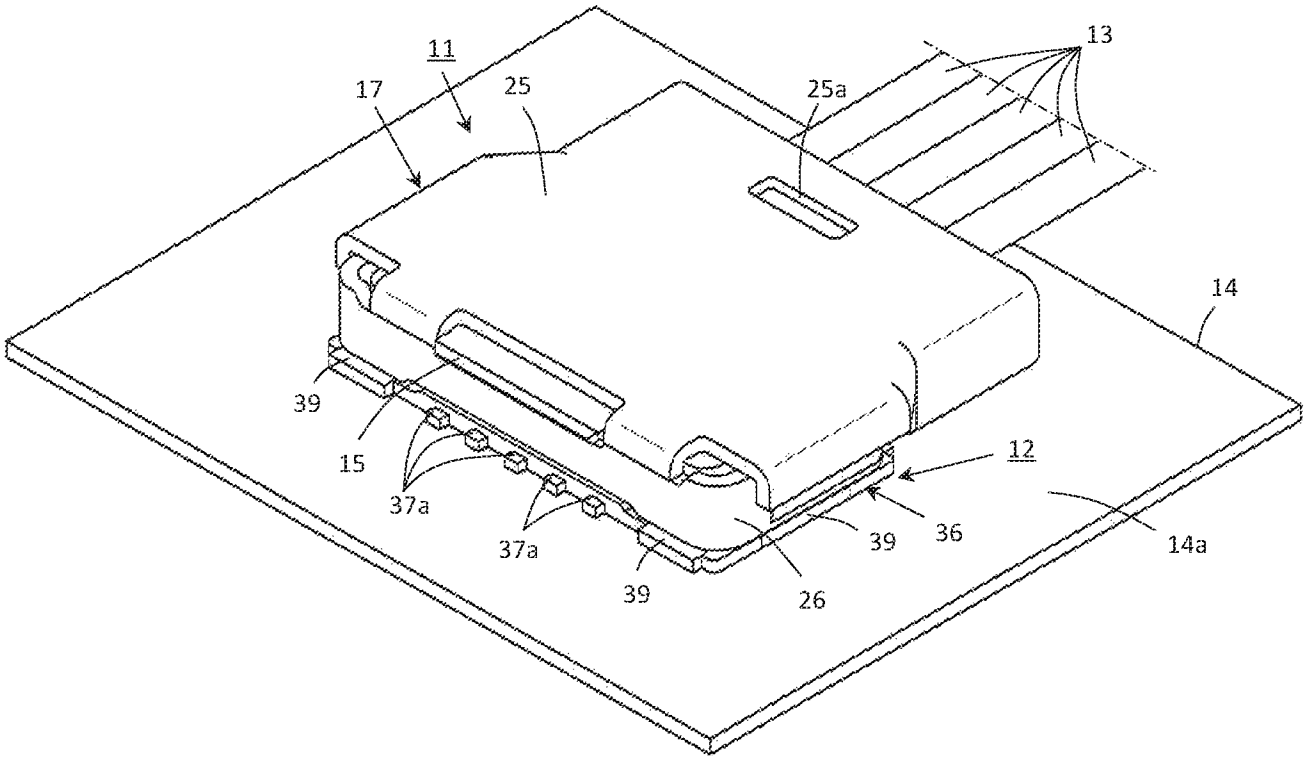
FIG. 11 is a schematic perspective view showing a condition wherein the plug connector accompanied with the coaxial cables as shown in FIG. 1 is coupled with the receptacle connector mounted on the circuit board as shown in FIG. 1.
Figure 12:
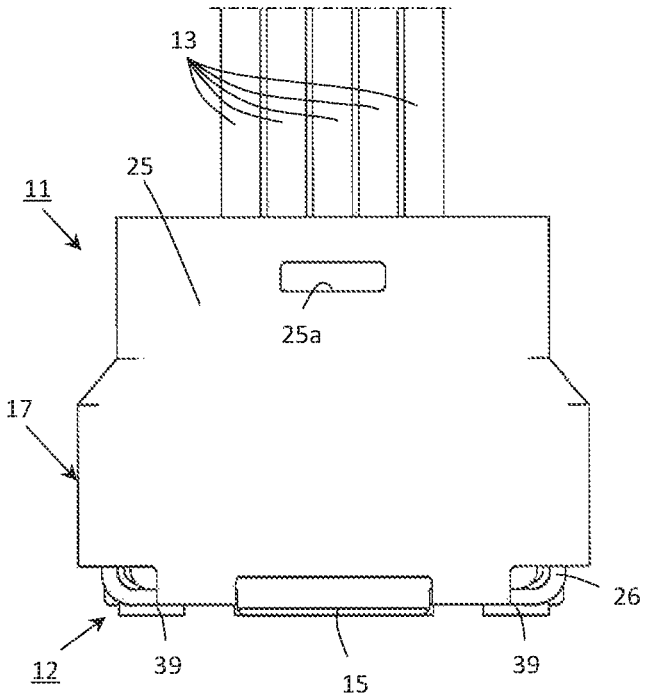
FIG. 12 is a schematic plan view showing a condition wherein the plug connector accompanied with the coaxial cables as shown in FIG. 1 is coupled with the receptacle connector shown in FIG. 1.
Figure 13:
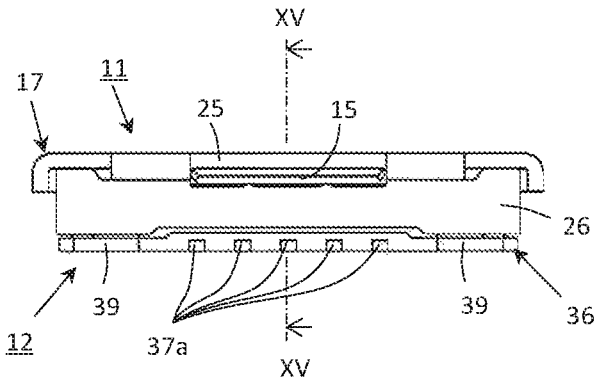
FIG. 13 is a schematic side view showing the condition wherein the plug connector accompanied with the coaxial cables as shown in FIG. 1 is coupled with the receptacle connector shown in FIG. 1.
Figure 14:
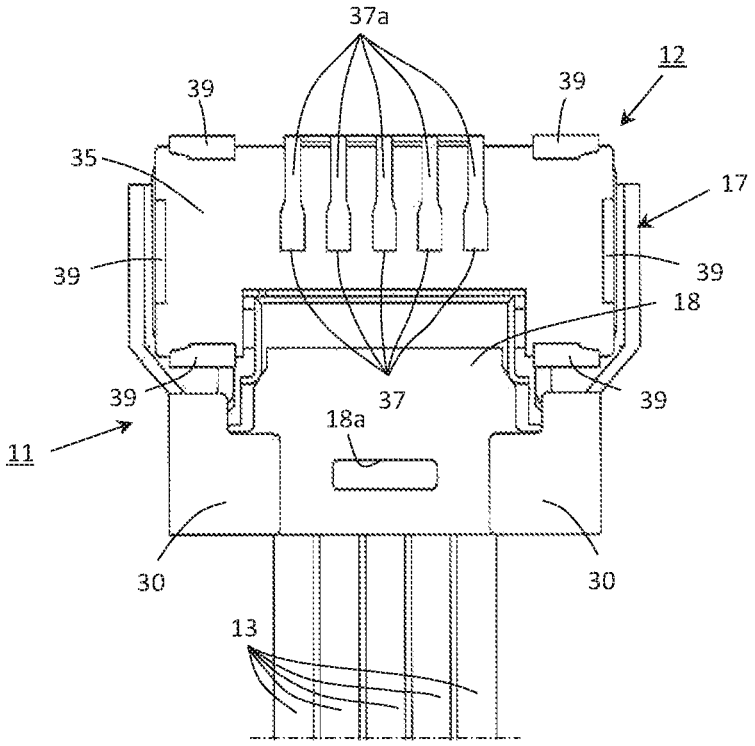
FIG. 14 is a schematic bottom view showing the condition wherein the plug connector accompanied with the coaxial cables as shown in FIG. 1 is coupled with the receptacle connector shown in FIG. 1.

On that occasion, under a situation wherein the coaxial cables 13 are connected with the plug connector 11, the insulating housing 15 of the plug connector 11 is fitted to the mate insulating housing 35 of the receptacle connector 12 in such a manner that the protrusion 35*a* provided on the mate insulating housing 35 of the receptacle connector 12 is inserted into the inside of the insulating housing 15 of the plug connector 11. As a result, the plug connector 11 accompanied with the coaxial cables 13 is put in connecting-coupling with the receptacle connector 12 accompanied with the circuit board 14, as shown in FIG. 11 (the schematic perspective view showing), FIG. 12 (the schematic plan view in which the circuit board 14 is omitted to be shown), FIG. 13 (the schematic side view in which the circuit board 14 are omitted to be shown), FIG. 14 (the schematic bottom view in which the circuit board 14 is omitted to be shown), and FIG. 15 (the schematic cross-sectional view taken along line XV-XV in FIG. 13).

Figure 15:
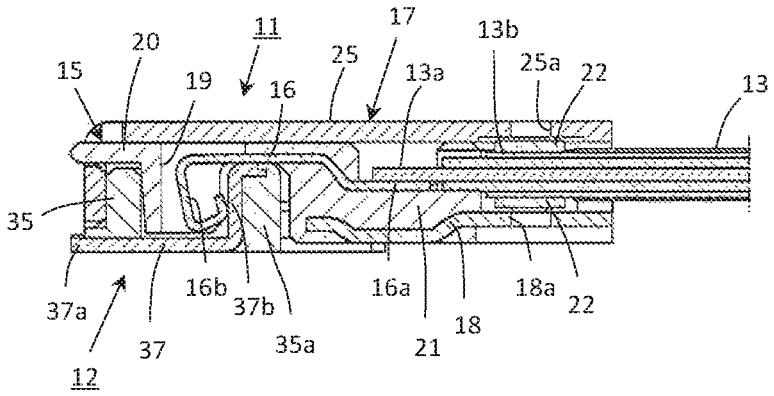
FIG. 15 is a schematic cross-sectional view taken along line XV-XV in FIG. 13.

Under a condition wherein the plug connector 11 is put in connecting-coupling with the receptacle connector 12, as shown in FIG. 15, the contact-connecting portions 16*b* of each of the conductive contacts 16 arranged on the insulating housing 15 of the plug connector 11 is caused to come into contact with the contact-connecting portion 37*b* of a corresponding one of the mate conductive contacts 37 arranged along the inside wall surface and the top surface of the protrusion 35*a* provided on the mate insulating housing 35 of the receptacle connector 12 so that the conductive contacts 16 of the plug connector 11 are contact-connected respectively with the mate conductive contacts 37 of the receptacle connector 12. As a result, the core conductor 13*a* of each of the coaxial cables 13 connected respectively with the cable connecting portions 16*a* of the conductive contacts 16 is linked, through the conductive contact 16 and the mate conductive contact 37, to a corresponding one of the circuit terminals provided on the parts-mounting surface 14*a* of the circuit board 14 with which the board connecting portions 37*a* of the mate conductive contacts 37 are connected respectively, so that the coaxial cables 13 are put in a condition of electrical connection with the circuit board 14.

Further, when the plug connector 11 is put in connecting-coupling with the receptacle connector 12, the strip-shaped portion 26 of the outer shell member 17 provided on the plug connector 11, which extends to surround partially the insulating housing 15, is operative to cause the inner surface portion thereof to come into resilient contact with the outer surface portion of the body portion 38 of the holding metal member 36 provided on the receptacle connector 12 so as to lock the plug connector 11 to the receptacle connector 12, as shown in FIGS. 11 to 14. Under such a condition, since the strip-shaped portion 26 of the outer shell member 17 having the end portions thereof from which the extended strip-shaped portions 27 extend respectively constitutes the spring member and each of the extended strip-shaped portions 27 of the outer shell member 17 is positioned from the outside thereof with the linking portion 28 extending from the concealing portion 25 of the outer shell member 17, a resilient pressing force by the spring member constituted with the strip-shaped portion 26 of the outer shell member 17, acts on the strip-shaped portion 26 so that the inner surface of the strip-shaped portion 26 is caused to contact resiliently with the outer surface portion of the body portion 38 of the holding metal member 36 provided on the receptacle connector 12. On that occasion, the extended strip-shaped portion 27 which elongates to be bent from the end portion of the strip-shaped portion 26 so as to have the free end portion and is positioned from the outside thereof with the linking portion 28 extending from the concealing portion 25, is operative to enhance the resilient pressing force by the spring member acting on the strip-shaped portion 26.

Accordingly, in the plug connector 11 provided with the outer shell member 17, the insulating housing 15 on which the conductive contacts 16 are arranged is provided with the cable supporting portion 21 for supporting the coaxial cables 13 connected respectively with the conductive contacts 16 and the cable supporting portion 21 is provided thereon with the inner shell member 18. The inner shell member 18 provided on the cable supporting portion 21 is made of metal plate material so as to be operative to reinforce the cable supporting portion 21 in the manner wherein the plug connector 11 is not prevented from being subjected to low profile. Therefore, with the plug connector 11, the cable supporting portion 21 of the insulating housing 15 is able to possess necessary and sufficient strength for supporting properly and stably the coaxial cables 13 even under a situation wherein the plug connector 11 is subjected to reduction in its thickness for achieving low profile.

Besides, in the plug connector 11, the strip-shaped portion 26 of the outer shell member 17 is able to keep sufficient resiliency even under a situation wherein the outer shell member 17 including the strip-shaped portion 26 is reduced in its size in a direction perpendicular to the parts-mounting surface 14*a* of the circuit board 14, to which the receptacle connector 12 is fixed, along with a reduction in thickness of the plug connector 11 for achieving low profile, and in addition, is less susceptible to changes with time on the same. Therefore, with the plug connector 11, the strip-shaped portion 26 of the outer shell member 17 on which the resilient pressing force by the spring member constituted with the strip-shaped portion 26 of the outer shell member 17 acts, is able to cause surely and stably the inner surface portion thereof to come into resilient contact with the outer surface portion of the body portion 38 of the holding metal member 36 provided on the receptacle connector 12 even under the situation wherein the plug connector 11 is subjected to reduction in its thickness for achieving low profile, so that the plug connector 11 is maintained properly and surely in connecting-coupling with the receptacle connector 12.

The invention claimed is:

1. An electrical cable connector comprising:

an insulating housing provided to be fitted to a mate insulating housing of a mate electrical connector fixed to a parts-mounting surface of a circuit board, a plurality of conductive contacts arranged on the insulating housing to be connected respectively with cables and put in contact respectively with mate conductive contacts provided in the mate electrical connector, and an outer shell member attached to the insulating housing for covering partially the insulating housing, wherein the insulating housing is provided with a cable supporting portion which is reinforced with an inner shell member made of metal plate material to be provided on the cable supporting portion for supporting the cables connected respectively with the conductive contacts, wherein the outer shell member includes a concealing portion for concealing a portion of the insulating housing on which the conductive contacts are arranged, a strip-shaped portion linked with the concealing portion to surround partially the insulating housing for coming into resilient contact with the mate electrical connector and a linking portion extending from the concealing portion to be linked with the inner shell member provided on the cable supporting portion, wherein the outer shell member further includes an extended strip-shaped portion extending from one of end portions of the strip-shaped portion, and wherein the linking portion has a constraining portion extending along an outer surface of the extended strip-shaped portion from the concealing portion and a covering portion elongating to be bendable from the constraining portion for covering the extended strip-shaped portion and the covering portion is operative to be bent and linked with the inner shell member.

2. An electrical cable connector according to claim 1, wherein the extended strip-shaped portion extends to be bent from the one of the end portions of the strip-shaped portion so as to have a free end portion and the linking portion is placed for positioning the extended strip-shaped portion.

3. An electrical cable connector according to claim 2, wherein the extended strip-shaped portion extends each of the end portions of the strip-shaped portion to constitute a pair of extended strip-shaped portions opposite to each other with the cable supporting portion therebetween and the linking portion is provided to correspond to each of the extended strip-shaped portions to constitute a pair of linking portions extending from the concealing portion of the outer shell member.

4. An electrical cable connector according to claim 1, wherein a cable connecting portion of each of the conductive contacts provided to be connected with a core conductor of the cable is exposed outward on the cable supporting portion of the insulating housing.

5. An electrical cable connector according to claim 4, wherein the cable supporting portion of the insulating housing is operative to support the cables each having the core conductor connected with the cable connecting portion of the conductive contact and an outer conductor linked with a pair of ground bar members facing each other.

6. An electrical cable connector according to claim 5, wherein a portion of the inner shell member is connected with one of the ground bar members.

7. An electrical cable connector according to claim 6, wherein the concealing portion of the outer shell member is connected with the other of the ground bar members.

* * * * *